United States Patent [19]

Iimura

[11] 4,292,733

[45] Oct. 6, 1981

[54] APPARATUS FOR COUPLING A PAIR OF ELONGATE SLIDE FASTENER STRINGERS

[75] Inventor: Yoshitaka Iimura, Kurobe, Japan

[73] Assignee: Yoshida Kogyo, K.K., Tokyo, Japan

[21] Appl. No.: 121,319

[22] Filed: Feb. 14, 1980

[30] Foreign Application Priority Data

Feb. 20, 1979 [JP] Japan ..... 54-20856[U]

[51] Int. Cl.[3] ..... B23P 19/04

[52] U.S. Cl. ..... 29/766

[58] Field of Search ..... 29/33.2, 408, 410, 766, 29/768, 771, 779, 816

[56] References Cited

U.S. PATENT DOCUMENTS

| | | | |
|---|---|---|---|
| 2,287,263 | 6/1942 | Nedal | 29/768 |
| 3,703,026 | 11/1972 | Uhrig | 29/766 X |
| 3,947,946 | 4/1976 | Omori et al. | 29/766 X |
| 4,238,880 | 12/1980 | Takahashi | 29/766 |

FOREIGN PATENT DOCUMENTS

| | | | |
|---|---|---|---|
| 637057 | 10/1936 | Fed. Rep. of Germany | 29/408 |
| 40-4101 | 3/1965 | Japan . | |

*Primary Examiner*—Ervin M. Combs

*Attorney, Agent, or Firm*—Robert E. Burns; Emmanuel J. Lobato; Bruce L. Adams

[57] ABSTRACT

An apparatus for coupling a pair of elongate slide fastener stringers while being fed longitudinally along a pair of respective paths, comprises a pair of first spaced rolls rotatable on a first shaft on a frame, a pair of second spaced rolls rotatable respectively on a pair of second shafts on the frame, which extend transversely to the first shaft, a pair of third rolls rotatable respectively on a pair of third shafts on the frame, which extend substantially parallel to the second shafts and are spaced from each other by a greater distance than that between the pair of second shafts, and a pair of fourth spaced rolls rotatable respectively on a pair of fourth shafts on the frame, which extend transversely to the third shafts. A coupling member on the frame has a pair of converging guide channels for meshing the stringers as they are withdrawn therethrough by withdrawing means. The first, second, third, fourth rolls, the coupling member and the withdrawing means are arranged in the order names for guiding the stringers along their respective paths into the coupling member. The third rolls enable the stringers to pass along a pair of converging paths leading respectively to the converging guide channels in the coupling member. The fourth rolls cause the stringers by width-wise engagement therewith to advance in a plane in which the converging guide channels lie.

9 Claims, 5 Drawing Figures

APPARATUS FOR COUPLING A PAIR OF ELONGATE SLIDE FASTENER STRINGERS

BACKGROUND OF THE INVENTION

1. Field of the Invention

The present invention relates to an apparatus for continuously coupling or meshing a pair of elongate slide fastener stringers of substantially endless length.

2. Prior Art

Japanese Patent Publication No. 40-4101 discloses coupling means for continuously meshing a pair of slide fastener stringers and a pair of spaced-apart guide rolls by which the stringers are guided for being fed along a pair of converging paths into the coupling means. The guide rolls have their axes extending transversely to the guide channel in the coupling means. Thus, the stringers as they enter the coupling means become forcibly twisted by the edges thereof before passing through the guide channel, with the results that the tapes and coupling elements tend to get caught and, at times, damaged by the coupling means.

Another coupling apparatus shown in German Pat. No. 637,057 has roller means for advancing a pair of slide fastener stringers smoothly into a fixedly held slider. The roller means includes an unnumbered block (FIG. 5) supporting inclined rollers, the block having a slot through which the stringer tape frictionally passes, with resulting wear on the tape. The slide fastener stringers are supplied from their respective rolls along parallel paths before being twisted and fed in a converging manner toward the slider. With such an arrangement, the parallel paths are widely spaced from each other so that the stringers moving along such paths cannot be processed such as for the mounting of coupling elements, the removing of selected groups of the coupling elements, and the attaching of reinforcing films, which would normally be performed on closely juxtaposed stringers before they are coupled together.

SUMMARY OF THE INVENTION

An apparatus for coupling a pair of elongate slide fastener stringers while being fed longitudinally along a pair of respective paths comprises a pair of first spaced rolls rotatable on a first shaft on a frame, a pair of second spaced rolls rotatable respectively on a pair of second shafts on the frame, which extend transversely to the first shaft, a pair of third rolls rotatable respectively on a pair of third shafts on the frame, which extend substantially parallel to the second shafts and are spaced from each other by a greater distance than that between the pair of second shafts, and a pair of fourth spaced rolls rotatable respectively on a pair of fourth shafts on the frame, which extend transversely to the third shafts. A coupling member on the frame has a pair of converging guide channels for meshing the stringers as they are withdrawn therethrough by withdrawing means. The first, second, third, fourth rolls, the coupling member and the withdrawing means are arranged in the order named for guiding the stringers along their respective paths into the coupling member. The third rolls enable the stringers to pass along a pair of converging paths leading respectively to a pair of converging guide channels in the coupling member. The fourth rolls allow the stringers by widthwise engagement therewith to advance in a plane in which the converging guide channels lie.

it is an object of the present invention to provide an apparatus for coupling a pair of slide fastener stringers smoothly and reliably without damages to the stringers.

Another object of the present invention is to provide such stringer-coupling apparatus having means for directing a pair of slide fastener stringers along their respective paths leading in coplanar relation to a pair of guide channels in a coupling member.

Still another object of the present invention is to provide an apparatus for coupling a pair of slide fastener stringers supplied along their respective parallel paths running relatively close to each other.

The above and other objects and advantages of the present invention will become apparent from the following description when taken in conjunction with the accompanying drawings.

DETAILED DESCRIPTION

Figure 1:
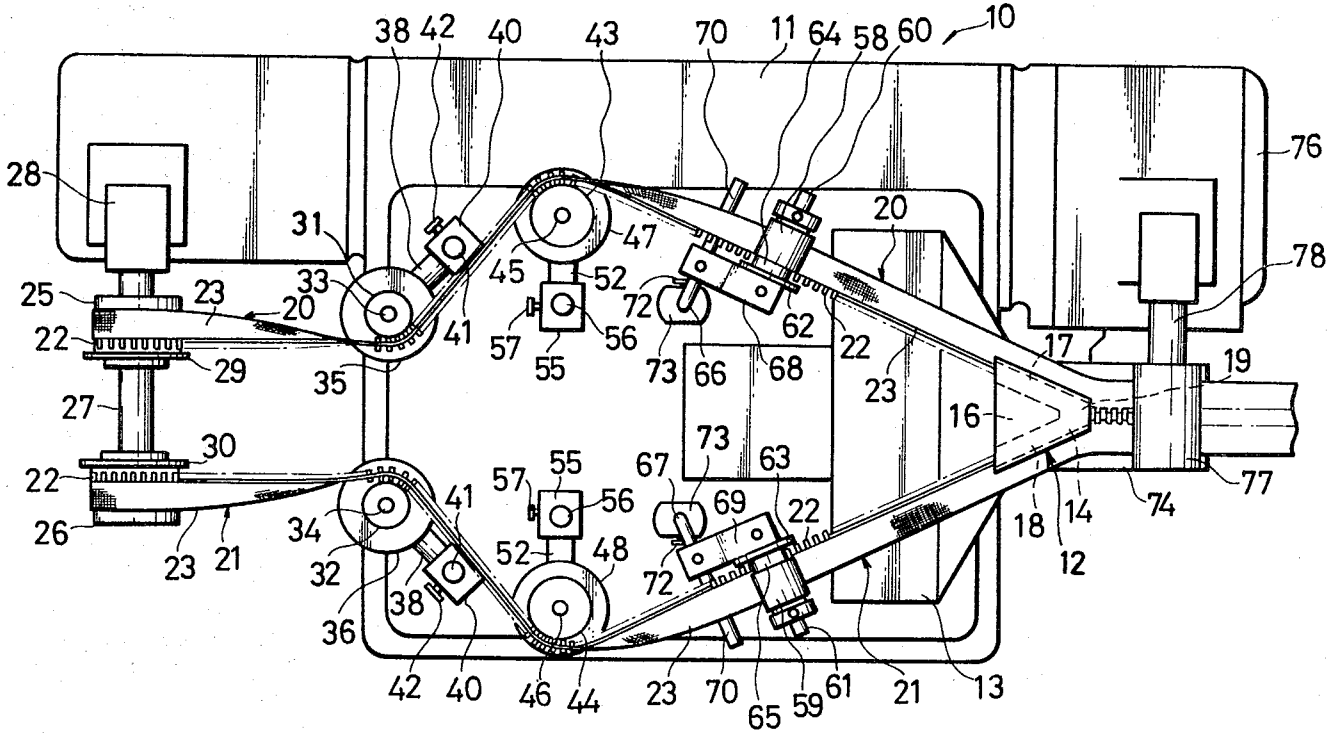
FIG. 1 is a plan view of an apparatus constructed in accordance with the present invention.
Figure 2:
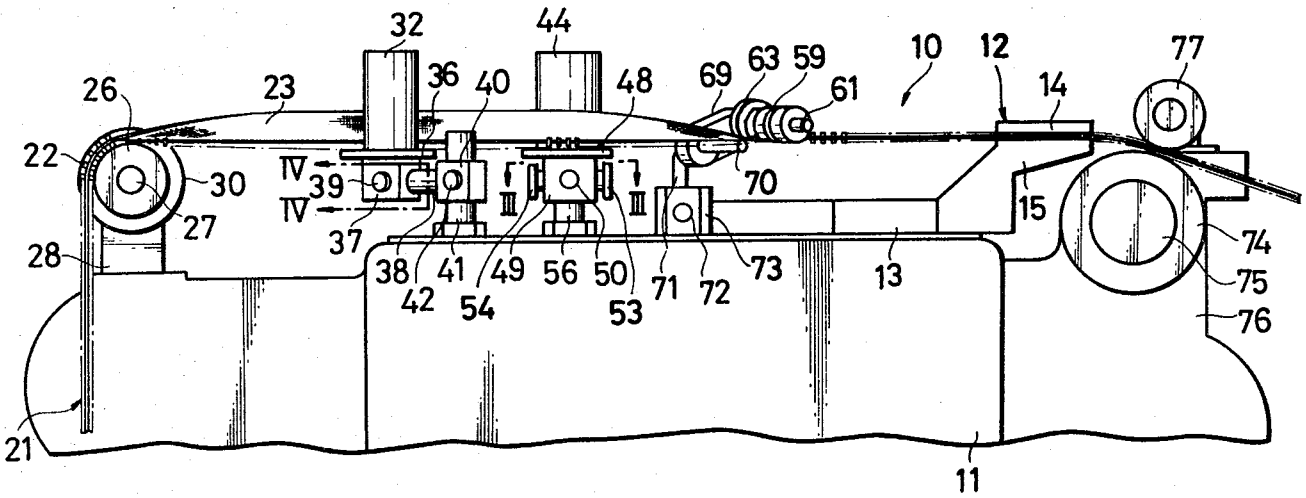
FIG. 2 is a front elevational view of the apparatus of FIG. 1.

As shown in FIGS. 1 and 2, an apparatus 10 according to the present invention comprises a frame 11 and a coupling member 12 mounted on a base 13 on the frame 11 and having an upper wing 14 and a lower wing 15 which are interconnected by a triangularly shaped guide post 16, thereby providing a pair of V-shaped converging guide channels 17,18 that meet each other at a discharge end 19.

A pair of continuous slide fastener stringers 20,21 of substantially endless length each have a row of coupling elements 22 mounted on one longitudinal edge of a stringer tape 23. The slide fastener stringers 20,21 independently enter the converging guide channels 17,18, respectively, and are coupled or mated together by the interengaging coupling elements 22 as they come out of the discharge end 19.

A pair of first guide rolls 25,26 are rotatably mounted on a horizontal shaft 27 supported by a support 28 on the frame 11. The first guide rolls 25,26 are axially spaced apart from each other so as to be disposed in the relatively close, parallel paths along which the slide fastener stringer 20,21 are supplied through a variety of processing stations such as for applying end stops, removing groups of coupling elements, and attaching reinforcing films, to the apparatus 10. The first guide rolls 25,26 have a pair of annular flanges 29,30, respectively, disposed in confronting relation to each other.

Figure 4:
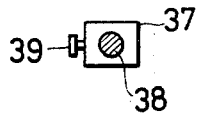
FIG. 4 is a cross-sectional view taken along line IV—IV of FIG. 2.

A pair of second guide rolls 31,32 are rotatably mounted respectively on a pair of second shafts 33,34 mounted on the frame 11 and extending transversely to the first shaft 27, and have a pair of respective annular flanges 35,36 that provide support for the slide fastener stringers 20,21 edgeways, such that the coupling elements 22 are borne by the annular flanges 35,36. The second guide rolls 31,32 are spaced from each other by a distance substantially equal to that by which the first guide rolls 25,26 are spaced from each other. Each of the second shafts 33,34 is mounted on a support 37 (FIGS. 2 and 4) tiltably fitted over a horizontal rod 38 and adjustably secured to the rod 38 by a setscrew 39. Thus, the support 37 and hence the second guide roll 31,32 are tiltable about the axis of the rod 38 by adjusting the setscrew 39. The rod 38 extends from a block 40 fitted over a vertical post 41 mounted on the frame 11 and secured to the post 41 by a setscrew 42.

Figure 3:
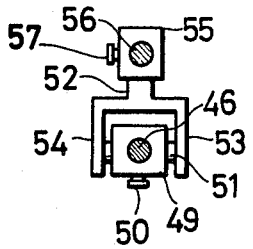
FIG. 3 is a cross-sectional view taken along line III—III of FIG. 2.

A pair of third guide rolls 43,44 are rotatably mounted respectively, on a pair of third shafts 45,46 mounted on the frame 11 and extending substantially parallel to the second shafts 33,34, and have a pair of respective annular flanges 47,48 for supporting the slide fastener stringers 20,21 edgeways. The third guide rolls 43,44 are spaced from each other by a greater distance than that between the pair of second shafts 33,34. Each of the third shafts 45,46 is mounted on a support 49 (FIG. 3) tiltably fitted over a horizontal rod 51 and adjustably secured to the rod 51 by a setscrew 50. The support 49 and hence the third guide roll 43,44 are likewise tiltable about the axis of the rod 51 by the adjustment of the setscrew 50. The rod 51 is supported between a pair of branching arms 53,54 of a bifurcated bar 52 secured to a block 55 fitted over a vertical post 56 and adjustably secured thereto by a setscrew 57.

A pair of fourth guide rolls 58,59 are rotatably mounted respectively on a pair of fourth horizontal shafts 60,61 mounted on the frame 11 and extending transversely to the third shafts 45,46. The fourth guide rolls 58,59 have a pair of respective annular flanges 62,63 and a pair of respective annular slots 64,65 disposed adjacent to the annular flanges 62,63, respectively, and receptive of the rows of coupling elements 22 for the guidance thereof. A pair of bent rods 66,67 are each adjustably secured by a setscrew 72 to a mount 73 on the frame 11, and include a horizontal portion 70 and a vertical portion 71. The fourth horizontal shafts 60,61 are supported by a pair of respective supports 68,69 on the horizontal portions 70 of the bent rods 66,67, respectively. The fourth guide rolls 58,59 are located between the coupling member 12 and the third guide rolls 43,44 and on a pair of respective converging lines extending from the converging guide channels 17,18 in the coupling member 12, with the fourth shafts 60,61 extending transversely to such converging lines. The first rolls 25,26, second rolls 31,32, third rolls 43,44, fourth rolls 58,59 and the coupling member 12 are arranged in the order named along a pair of paths for the respective slide fastener stringers 20,21.

A drive roller 74 is fixed to a drive shaft 75 of a motor 76 mounted on the frame 11 and is disposed adjacent to and downstream of the discharge end 19 of the coupling member 12. A pinch roller 77 is rotatably supported by a shaft 78 mounted on the motor 76. The slide fastener stringers 20,21 as they issue coupled from the coupling member 12, are sandwiched between the driven roller 74 and the pinch roller 77, and are sandwiched between the drive roller 74 and the pinch roller 77, and are longitudinally withdrawn by the rotation of the drive roller 74.

In one mode of operation of the apparatus 10, the second shafts 33,34 and the third shafts 45,46 are held vertically in perpendicular relation to the frame 11 by the adjustment of the setscrews 39,50. With these shafts thus positioned, each of the first and fourth rolls 25,26 and 58,59 has a tangential plane lying in substantially coplanar relation to the guide channels 17,18 in the coupling member 12 and to the annular flanges 35,36 and 47,48 of the respective second and third rolls 31,32 and 43,44 as best illustrated in FIG. 2. The slide fastener stringers 20,21 are supplied peripherally around the first rolls 25,26, respectively, with the rows of coupling elements 22,22 disposed adjacent to the annular flanges 29,30. The stringers 20,21 are advanced horizontally to the second rolls 31,32, respectively, and then are fed peripherally therearound along their respective diverging paths toward the third rolls 43,44, respectively, whereupon the stringers 20,21 are twisted through 90 degrees and held vertically edgeways on, or with the rows of coupling elements 22,22 disposed on, the annular flanges 35,36 and 47,48 of the second and third rolls 31,32 and 43,44. The slide fastener stringers 20,21 are then directed toward the coupling member 12 along their respective converging paths leading straightforwardly to the converging guide channels 17,18 in the coupling member 12 as the stringers 20,21 pass over the horizontal portions 70,70 of the rods 66,67 and under the fourth rolls 58,59, respectively, in widthwise engagement therewith, whereby the stringers 20,21 are caused to advance in a horizontal plane in which the guide channels 17,18 lie. At this time, the rows of coupling elements 22,22 are located inwardly and are guided by the annular slots 64,65 in the fourth rolls 58,59 so as to be in line with the guide channels 17,18, respectively. The stringers 20,21 thus enter the respective guide channels 17,18 smoothly without getting caught or jammed.

With such an arrangement, the rows of coupling elements 22,22 of the slide fastener stringers 20,21 can be interengaged smoothly and continuously because the guide channels 17,18 in the coupling member 12 lie in the same plane as that in which the stringers 20,21 are advanced convergently toward the coupling member 12, and an angle formed between the converging guide channels 17,18 is the same as that formed between the converging paths for the stringers 20,21, leading to the guide channels 17,18. Such an angle between the converging paths that the stringers 20,21 travel along beyond the third rolls 43,44 is formed by the second and third rolls 31,32 and 43,44 which jointly direct the stringers 20,21 away from their relatively close, parallel paths provided by the guide rolls 25,26.

Figure 5:
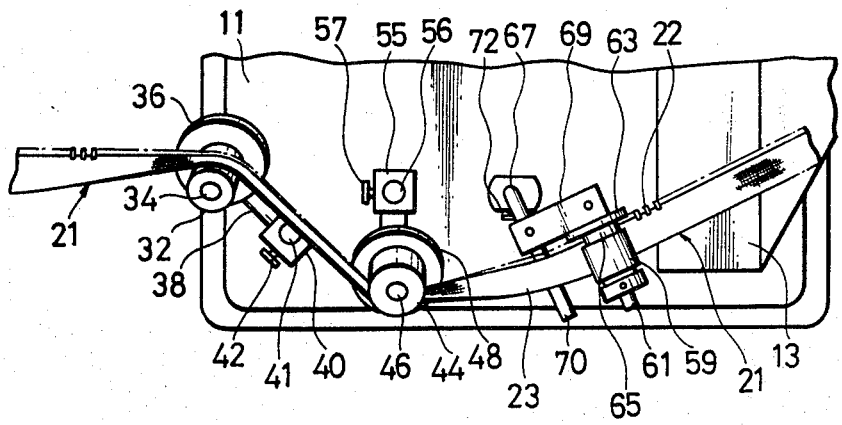
FIG. 5 is a fragmentary plan view of the apparatus shown in FIG. 1, with second and third rolls in a tilted position.

According to another mode of operation of the apparatus 10, the second shafts 33,34 and the third shafts 45,46 are tilted outwardly as shown in FIG. 5 so that the stringers 20,21 are twisted through less 90 degrees and hence are subjected to the less stress while guided around the second rolls 31,32 and the third rolls 43,44. The tilting of the second shafts 33,34 is effected by turning the supports 37,37 about the rods 38,38 and tightening the setscrews 39,39 to hold the supports 37,37 in the tilted position with respect to the rods 38,38. Likewise, the supports 49,49 for the third shafts 45,46 are tilted about the rods 51,51 and are held in the tilted position by tightening the setscrews 50,50.

Although a preferred embodiment has been shown and described in detail, it should be understood that changes and modifications may be made therein without departing from the scope of the appended claims.

What is claimed is:

1. An apparatus for coupling a pair of elongate slide fastener stringers while being fed longitudinally along a pair of respective paths, comprising:

(a) a frame;

(b) a pair of first spaced rolls rotatable on a first shaft on said frame;

(c) a pair of second spaced rolls rotatable respectively on a pair of second shafts on said frame, which extend transversely to said first shaft;

(c) a pair of third rolls rotatable respectively on a pair of third shafts on said frame, which extend substantially parallel to said second shafts and are spaced from each other by a greater distance than that between said pair of second shafts;

(e) a pair of fourth spaced rolls rotatable respectively on a pair of fourth shafts on said frame, which extend transversely to said third shafts;

(f) a coupling member on said frame, having a pair of converging guide channels for meshing the stringers as they pass therethrough;

(g) means for withdrawing the slide fastener stringers as they are coupled together by said coupling member; and (h) said first, second, third, fourth rolls, said coupling member and said withdrawing means being arranged in the order named for guiding the stringers along their respective paths into said coupling member, said third rolls enabling the stringers to pass along a pair of converging paths leading respectively to said converging guide channels in said coupling member, and said fourth rolls allowing the stringers by widthwise engagement therewith to advance in a plane in which said converging guide channels lie.

2. An apparatus according to claim 1, each of said second and third rolls including an annular flange for supporting one of the stringers edgeways, and each of said first and fourth rolls having a tangential plane in substantially coplanar relation to said annular flange.

3. An apparatus according to claim 2, said guide channels in said coupling member lying in said tangential plane.

4. An apparatus according to claim 1, said fourth shafts extending transversely to said converging paths, respectively.

5. An apparatus according to claim 4, including a pair of rods mounted on said frame and disposed adjacent to and extending parallel to said fourth shafts, respectively, so that each of the stringers can pass over one of said rods and under associated one of said fourth rolls.

6. An apparatus according to claim 1, said withdrawing means comprising a drive roller and a pinch roller which are rotatably mounted on said frame for sandwiching therebetween the coupled slide fastener stringers.

7. An apparatus according to claim 1, including means supporting each of said second shafts so as to be tiltable away from the other.

8. An apparatus according to claim 7, said supporting means comprising a rod mounted on said frame and a support supporting said second shaft and adjustably mounted on said rod.

9. An apparatus according to claim 7, said supporting means comprising a bifurcated bar mounted on said frame, a rod extending between the branching arms of said bar, and a support supporting said second shaft and adjustable mounted on said rod.

* * * * *